US007086959B2

(12) United States Patent
D'Agguano

(10) Patent No.: US 7,086,959 B2
(45) Date of Patent: Aug. 8, 2006

(54) GOLF PUTTER

(75) Inventor: Frank D'Agguano, Aventura, FL (US)

(73) Assignee: The O Corporation, Delray Beach, FL (US)

( * ) Notice: Subject to any disclaimer, the term of this patent is extended or adjusted under 35 U.S.C. 154(b) by 0 days.

(21) Appl. No.: 10/701,177

(22) Filed: Nov. 5, 2003

(65) Prior Publication Data

US 2004/0147334 A1 Jul. 29, 2004

Related U.S. Application Data

(60) Provisional application No. 60/442,044, filed on Jan. 23, 2003.

(51) Int. Cl.
*A63B 53/04* (2006.01)
*A63B 47/02* (2006.01)

(52) U.S. Cl. ..... 473/282; 473/286; 473/340

(58) Field of Classification Search ..... 473/286, 473/313, 340–341, 282; 294/19.2; D21/739
See application file for complete search history.

(56) References Cited

U.S. PATENT DOCUMENTS

| | | | | |
|---|---|---|---|---|
| 1,960,110 | A | 5/1934 | Iles | |
| 3,632,112 | A * | 1/1972 | Jacobs | 473/286 |
| 3,708,172 | A | 1/1973 | Rango | |
| D235,668 | S | 7/1975 | Swash | |
| 4,204,577 | A * | 5/1980 | Bittle | 172/25 |
| D257,870 | S | 1/1981 | MacDougall | |
| 4,248,430 | A | 2/1981 | Kepler | |
| 4,580,784 | A | 4/1986 | Brill | |
| 4,934,702 | A | 6/1990 | Serizawa | |
| D310,115 | S | 8/1990 | Iinuma | |
| 4,976,436 | A | 12/1990 | Serizawa | |
| D314,031 | S | 1/1991 | Iinuma | |
| D316,129 | S | 4/1991 | Bryson | |
| 5,211,401 | A | 5/1993 | Hainey | |
| 5,388,827 | A * | 2/1995 | Reynolds, Jr. | 473/306 |
| 5,637,044 | A | 6/1997 | Swash | |
| 5,692,968 | A * | 12/1997 | Shine | 473/286 |
| D388,853 | S * | 1/1998 | Minami | D21/745 |
| D402,724 | S | 12/1998 | Minami | |
| D408,878 | S | 4/1999 | Patten | |
| D412,729 | S | 8/1999 | Woodward | |
| D441,041 | S | 4/2001 | Opie | |
| 6,267,689 | B1 | 7/2001 | Ambrose | |
| 6,379,259 | B1 | 4/2002 | Opie | |
| 6,383,089 | B1 | 5/2002 | Bonneau | |

* cited by examiner

*Primary Examiner*—Stephen Blau
(74) *Attorney, Agent, or Firm*—Millen, White, Zelano, Branigan, P.C.

(57) ABSTRACT

The present invention provides a golf club putter and more specifically a putter head configuration which incorporates a golf ball receiving/retreieving and retaining aperture, which will permit a golfer to accomplish virtually effortless ball retrieval from a hole, green, water hazard or other portions of a golf course without bending over. The configuration allows a wide variety of golf ball sizes to be retrieved. Furthermore, the invention provides a means for a golfer to retrieve a golf club or a flag stick from the ground without the necessity of bending over.

12 Claims, 9 Drawing Sheets

GOLF PUTTER

This application claims benefit of provisional application No. 60/442,044, filed 23 Jan. 2003 whose entire disclosure is incorporated by reference herein.

Studies in the United States show that between 40 and 50 percent of all golfers, professionals and amateurs alike, suffer from back problems. Back injury is the most common golf injury, caused mostly due to over exertion. Some persons have physical impairments that prevent them from bending to pick up a golf ball, golf club or flag stick from the ground. Even for those not specifically so impaired, sometimes the effort of stooping/bending over many times during a round of golf in order to retrieve a golf ball, other golf club or the flag on the green becomes tedious, and in some cases tiring. This is particularly true among the growing senior population in this country as well as many other countries throughout the world. This problem however is certainly not limited solely to these persons, many of whom play golf for recreational purposes. The rotational forces on the golfer's back resulting from a golf swing are equal to more than eight times normal body weight and can negatively affect the back's bones, discs, ligaments and muscles. Further stress is placed on the back by the repetitive nature of bending to retrieve golf balls, flag sticks and other golf clubs on the green and off the green. This repetition can directly cause injury to a golfer's back or further exacerbate a pre-existing condition. In addition, more times than not, when recreational golfer's bend or stoop over to manually retrieve a golf ball from a cup, they generally place one foot flat on the ground, bearing the majority of body weight very close to the edge around the cup and move the other foot to the side or behind them. The shoe near the edge of the cup receives the majority of the golfer's weight. This weight exerted near the cup in a very small area often dents the area around the cup and/or damages the putting green turf. Thus, the simple act of bending near the golf cup to pick up a ball inadvertently can cause varying degrees of damage to the putting green in one of the most important areas immediately surrounding the cup where at the last moment the golf ball either drops into the cup or misses the cup. There have been numerous attempts to address this problem by configuring putters to pick up golf balls. A problem not adequately addressed by the prior art is sucessfully coordinating in a single putter the ability to pick up golf balls of various sizes with the same putter.

SUMMARY OF THE INVENTION

The present invention provides a golf club putter and more specifically a putter head configuration which incorporates a golf ball receiving/retrieving and retaining aperture, which will permit a golfer to accomplish virtually effortless golf ball retrieval, e.g., without unnecessary additional stress to the golfer's back, hips or knees. Thus, the present invention relates generally to golf putters, and more specifically to a golf putter head useful for extracting, raising, retrieving and/or retaining a golf ball, e.g., from a golf hole/cup or green without bending over.

Another aspect of the present invention relates to a golf putter head useful for raising/extracting and retrieving a golf club and or flag stick from a green, fairway or rough without bending over.

Yet another aspect of the present invention provides a golf putter head useful for extracting, raising, retrieving and/or retaining a golf ball while accomodating a wide range of golf ball sizes. In the event that a retrieved golf ball's diameter is too small to be gripped by the receiving aperture or more additional downward force than necessary for gripping is applied, the golf ball can pass through the receiving aperture and is still retained. In such cases where the ball passes through the receiving aperture, it is maintained off center by a surface feature of the putter head. Thus, the ball is prevented from falling back through the receiving aperture.

Yet another aspect of the present invention provides a golf putter head useful for retrieving a golf ball from a water hazard.

In a preferred embodiment, the putter has a front putter face and a bottom flange extending rearward from the putter face. The bottom flange has a ball-receiving aperture the diameter of which is sufficient to grip a golf ball when the edges of the receiving aperture are gently pressed against the golf ball. Depending on the diameter of the golf ball, the flange is sufficiently thin at the point of contact with a gripped ball to permit passage of a gripped ball through the receiving aperture upon application of additional downward force, if desired. A top surface of the putter extends rearward from the putter face. Portions of the top surface extend slightly over the receiving aperture forming an interference lip. When a golf ball passes upwardly through the receiving aperture it is situated at rest off-center with respect to the receiving aperture, thereby preventing the golf ball from passing downwardly through the receiving aperture by the force of gravity.

In yet another aspect of the invention, the top surface of the putter head and the bottom flange are spaced apart. The thickness of the top surface may decrease towards the rear of the top surface. Preferably, the front of the top surface and the bottom flange have a vertical spacing between them ranging from approximately 0.2 to approximately 0.75 inches (about 5.1–19 mm). This vertical spacing may become greater towards the rear of the top surface to provide a slot, which is sufficiently sized to grip a flagstick and/or a golf club shaft, thereby providing a golfer the ability to pick up such items without bending at all.

In yet another aspect of the invention, the bottom surface of the lip and the op surface of the bottom flange may have a vertical spacing of about 0.2 to about 0.75 inch. Preferably, the bottom surface of the lip and the top surface of the bottom flange are generally parallel to each other and have a vertical spacing of about 0.2 to about 0.5 inch.

Thus in one aspect, the invention relates to a golf club putter having a shaft, a handle/grip and a putter head useful for retrieving/extracting a golf ball comprising a front putter face, and a bottom flange extending rearward from said putter face. The flange has a ball-receiving aperture that has a diameter sufficient that the edges of the receiving aperture grip said ball when the receiving aperture is gently pressed against a ball. The flange is sufficiently thin at the point of contact with said gripped ball to permit passage of a gripped ball through the receiving aperture upon application of additional downward force. A portion of the top surface of the putter head extends over the receiving aperture such that, when said ball passes upwardly through said hole, it is situated at rest off-center with respect to the receiving aperture thereby preventing the ball from passing downwardly through said receiving aperture by the force of gravity. The rear of the top surface of said putter head is spaced vertically from the bottom flange to provide a slot, which allows gripping or receiving a golf club and/or a flagstick.

In other preferred aspects of the invention the largest dimension of the putter head is slightly less than the diameter of a standard golf cup.

In yet another preferred aspect of the invention the ball-receiving aperture diameter is sufficient to grip a golf ball when the edges of the receiving aperture are gently pressed against the golf ball. More preferably, the receiving aperture diameter is less than about 1.684 inches (42.774 mm) but greater than about 1.674 inches (42.52 mm) and most preferably the receiving aperture diameter is from about 1.676 to 1.680 inches (about 42.57–42.67 mm).

This invention relates to a putter head useful for retrieving a golf ball comprising:

a front putter face, a bottom flange extending rearward from said putter face, said flange having a ball receiving aperture that has a diameter sufficient that the edges of the receiving aperture grip said ball when the receiving aperture is pressed against said ball, said flange being sufficiently thin at the point of contact with said gripped ball to permit passage of said gripped ball through said receiving aperture upon application of additional downward force, and a top surface of said putter face, which extends over said receiving aperture such that, when said ball passes upwardly through said hole, it is situated at rest off-center with respect to said receiving aperture preventing the ball from passing downwardly through said receiving aperture by the force of gravity.

This invention also relates to a putter head useful for retrieving a golf ball comprising:

a front putter face, a bottom flange extending rearward from said putter face, said flange having a ball receiving aperture that has a diameter sufficient that the edges of the receiving aperture grip said ball when the receiving aperture is pressed against said ball, said bottom flange being sufficiently thin at the point of contact with said gripped ball to permit passage of said gripped ball through said receiving aperture upon application of additional downward force.

This invention also relates to a putter head useful for retrieving a golf ball comprising:

a front putter face, a bottom flange extending rearward from said putter face, said flange having a ball receiving aperture that has a diameter sufficient that the edges of the receiving aperture grip said ball when the receiving aperture is pressed against said ball, and a coupling configured on the putter head for detachably gripping a golf club and/or a flagstick.

The following description is described with reference to the accompanying figures.

Figure 1:
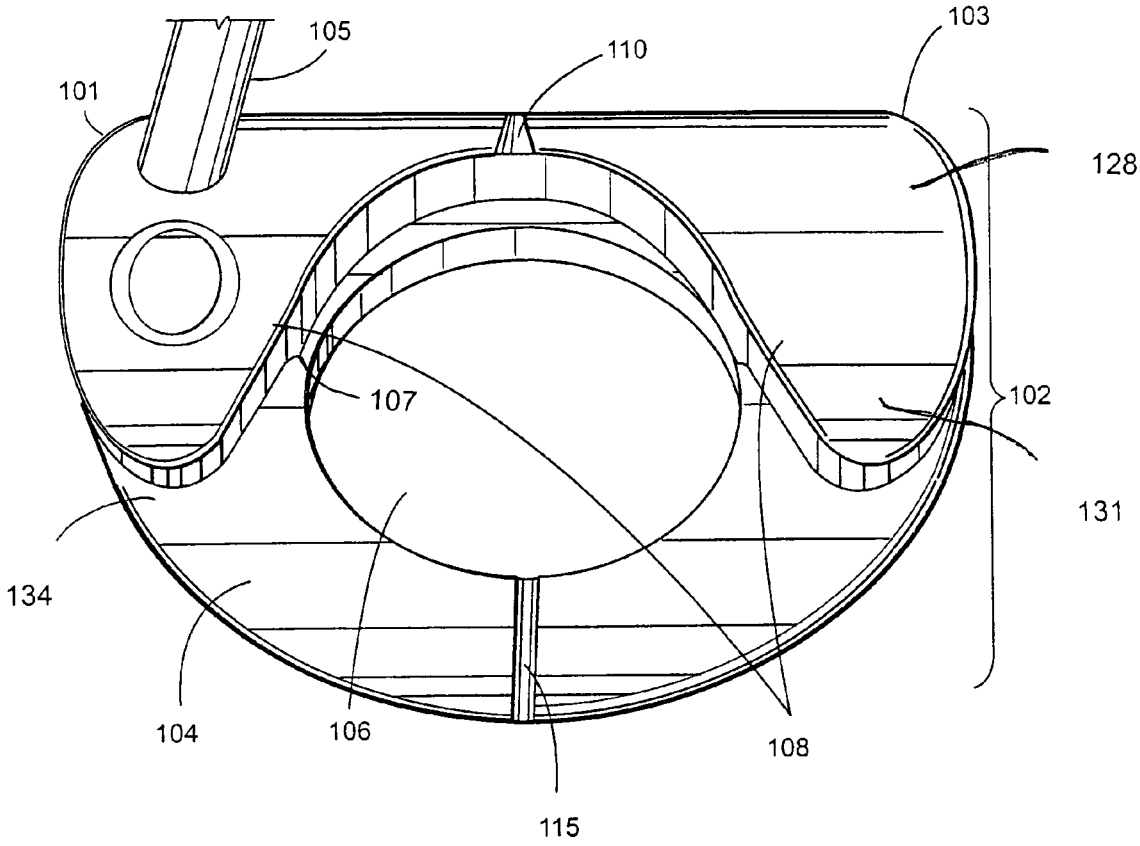
FIG. 1 depicts a top perspective view of the back of one embodiment of the golf putter head of the present invention.
Figure 2:
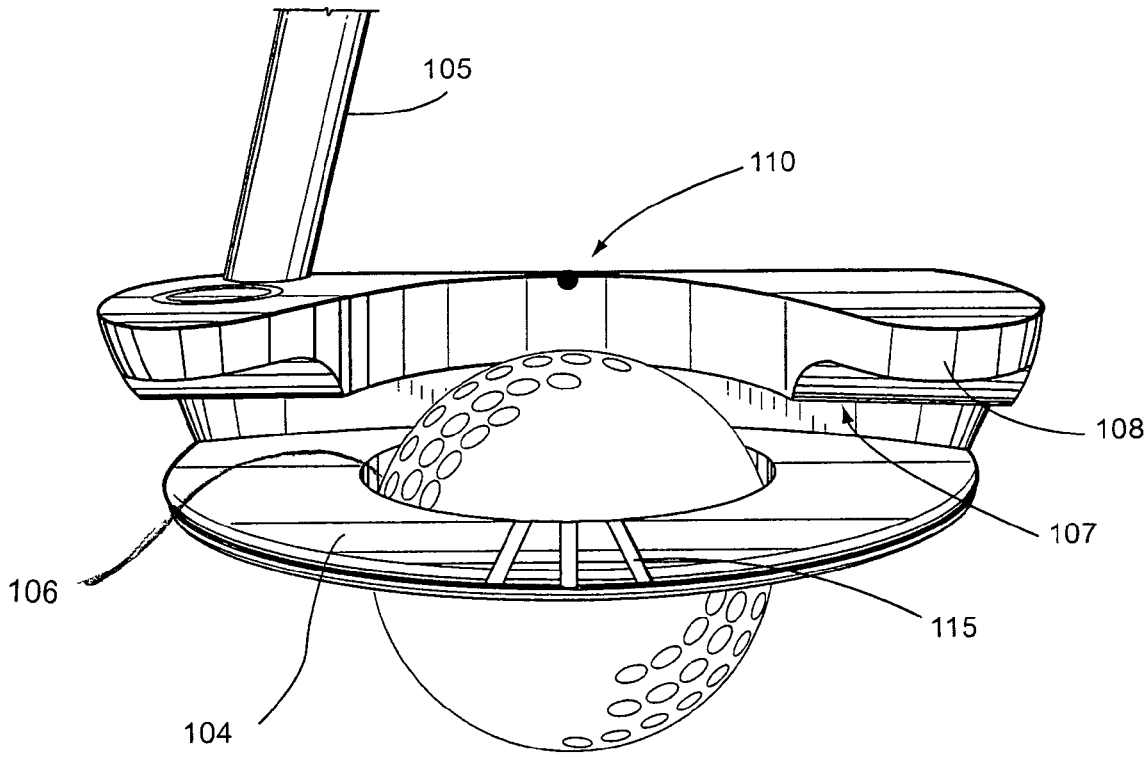
FIG. 2 is a backside view of one embodiment of the present invention depicting the interference fit between the ball and the bottom flange (104).

FIG. 1 is a top rear perspective view of a golf putter (100) having a head (102), which is attached to a putter shaft (105). Head (102), in addition to providing the ability to stroke a ball when putting, is also adapted to assist a golfer to pick-up/retrieve a golf ball lying on the ground, inside the cup of a hole and/or on a putting green, in a water hazard or elsewhere. In one preferred implementation, the total length of head (102), measured from heel portion (101) to toe portion (103), is approximately 3.75 inches (approximately 95.25 mm). Thus, head (102) will fit into most standard golf ball cups. See FIG. 4. The total length may be smaller or larger, even larger than a golf ball cup diameter (typically about 4 inches or 101.6 mm), but preferably less then such diameter.

Head (102) includes a bottom flange (104) extending rearward from the face and forming the bottom of putter (100). A receiving aperture (106) through bottom flange (104) provides a passage capable of receiving a golf ball. The aperture (106) is generally in the shape of a golf ball (e.g., circular) having a diameter that is slightly larger, the same size, or slightly smaller than the diameter of most golf balls. Preferably, the receiving aperture has a diameter sufficient that the edges of the receiving aperture gently grip the golf ball when the receiving aperture is gently pressed against the golf ball. The most preferred diameter of the receiving aperture (106) is slightly less than the diameter of a golf ball (to conform to USGA standards, golf balls have a diameter of not less than 1.680 inches or 42.67 mm); however, other ranges such as 1.584 to 1.634 inches (40.23–41.50 mm) may be selected. The thickness of receiving aperture (106) is preferably from about ⅛ of an inch to about 3⁄16 of an inch (about 3.17 to 4.76 mm).

Above the flange (104) can be a lip (108), portions of which extend slightly over the receiving aperture (106) when looking down on head (102). Lip (108) provides a loose, off-center interference fit between the golf ball and the flange (104) so that the golf ball is secured. Accordingly, the golf ball is engaged through receiving aperture (106) by gently placing putter head (102) over the golf ball and placing slight downward pressure on the putter to push the golf ball through receiving aperture (106). A golf ball which passes through receiving aperture (106), may become secured between the bottom surface (107) of the front (128) of the lip (108) and flange (104), because the ball will be held off center. Together the bottom surface (107) and the lip (108) form the top surface of the putter. The top surface has a front (128) and a rear (131) portion. The thickness of the lip may be thicker towards the front (128) of the top surface and thinner towards the rear (131) of the top surface. Generally, depending on the golf ball diameter, when the golf ball is engaged in the receiving aperture it may not be easily dislodged (i.e., inadvertently fall back to the ground or into the ball cup) from motion of the head in any direction.

Figure 3A:
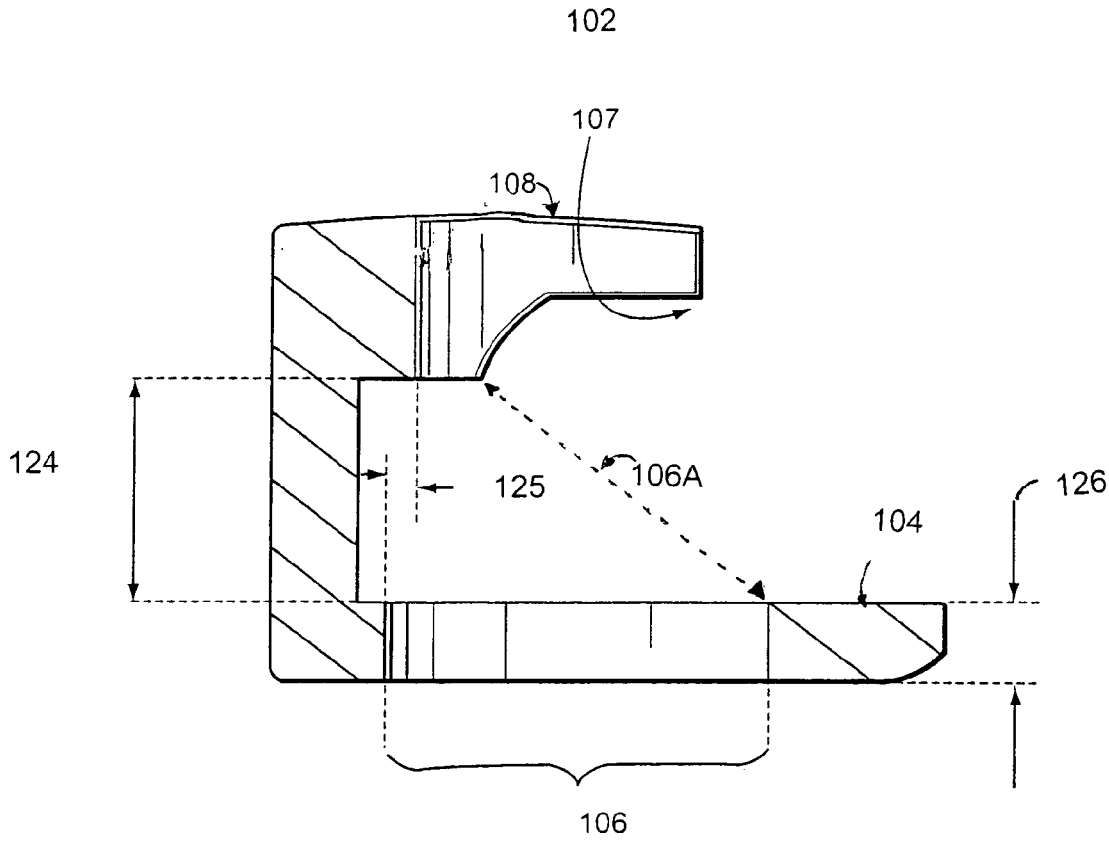
FIG. 3A is a center cross sectional view of head (102).
Figure 3B:
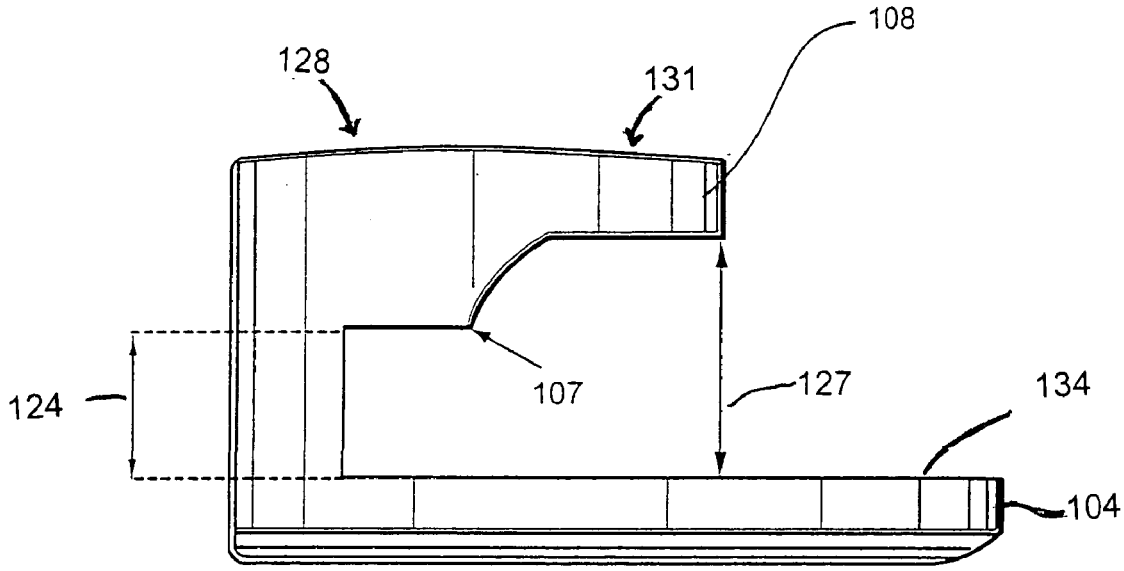
FIG. 3B is a side cross sectional view of the head (102) showing changes in spacing relationship between the bottom flange (104) and the lip (108). In this embodiment the space between the bottom flange and the lip is greater towards the rear of the putter head.

In one embodiment, the front (128) of the bottom surface (107) of lip (108) is preferably spaced (124) about 0.274–0.43 inches (6.95–11 mm) above the top of receiving aperture (106), but other dimensions, slightly smaller or larger, may be selected. Additionally, lip (108) has the same overall general diameter as receiving aperture (106) near a center point (110) of head (102), but the diameter of lip (108) can expand (get larger) in either direction at locations further from the center of head (102). To provide the interference fit of the golf ball between flange (104) and lip (108), the diameter of lip (108) near center point (110) is slightly offset (125) with respect to the diameter of receiving aperture (106) to provide the interference to grip the golf ball. For example, in one implementation the lip (108) is offset (125) about 0.060 inches (1.52 mm) relative to the front edge of receiving aperture (106). Slightly, larger or smaller offsets could be selected. FIG. 3A is a cross sectional view of head (102) showing various preferred dimensions of flange (104), receiving aperture (106), and lip (108) described above, and their relational measurements with respect to each other. For example, flange (104) is preferably from about ⅛ of an inch to about 3/16 of an inch (about 3.17 to 4.76 mm) thick (126). Offset (125) is preferably 0.060 inches (1.52 mm) and the space (124) between the front of the bottom surface (107) of lip (108) is preferably about 0.274–0.43 inches (6.95–11 mm) (124) above the top of receiving aperture (106). FIG. 3B shows a preferred embodiment depicting a change in the range of thickness of the top surface as the spacing relationship between the bottom flange and the bottom surface (107) of lip (108) changes. For example, the front portion (128) of lip (108), which oversets the receiving aperture, may preferably be spaced (124) about 0.273 to 0.433 inches (about 6.93 mm to about 11 mm) above the top surface (134) of the bottom flange. Most preferably, the front portion (128) of the bottom surface (107) of lip (108) may be spaced about 8–10 mm above the top surface (134) of the bottom flange (104). As the lip (108) extends towards the rear (131), the thickness may change. In one embodiment (FIG. 8), the lip thins towards the rear (131) so that the rear (131) of the bottom surface (107) of lip (108) is spaced to form a vertical/slot space (127) that is sufficient to detachably couple an object (e.g., a golf club shaft or flag pole etc.). Preferably, the slot/vertical space (127) is about 0.512 to 0.75 inches (13 to 19 mm), most preferably the vertical/slot space (127) is from about 0.55 to 0.63 inches (about 14 to 16 mm).

Figure 4:
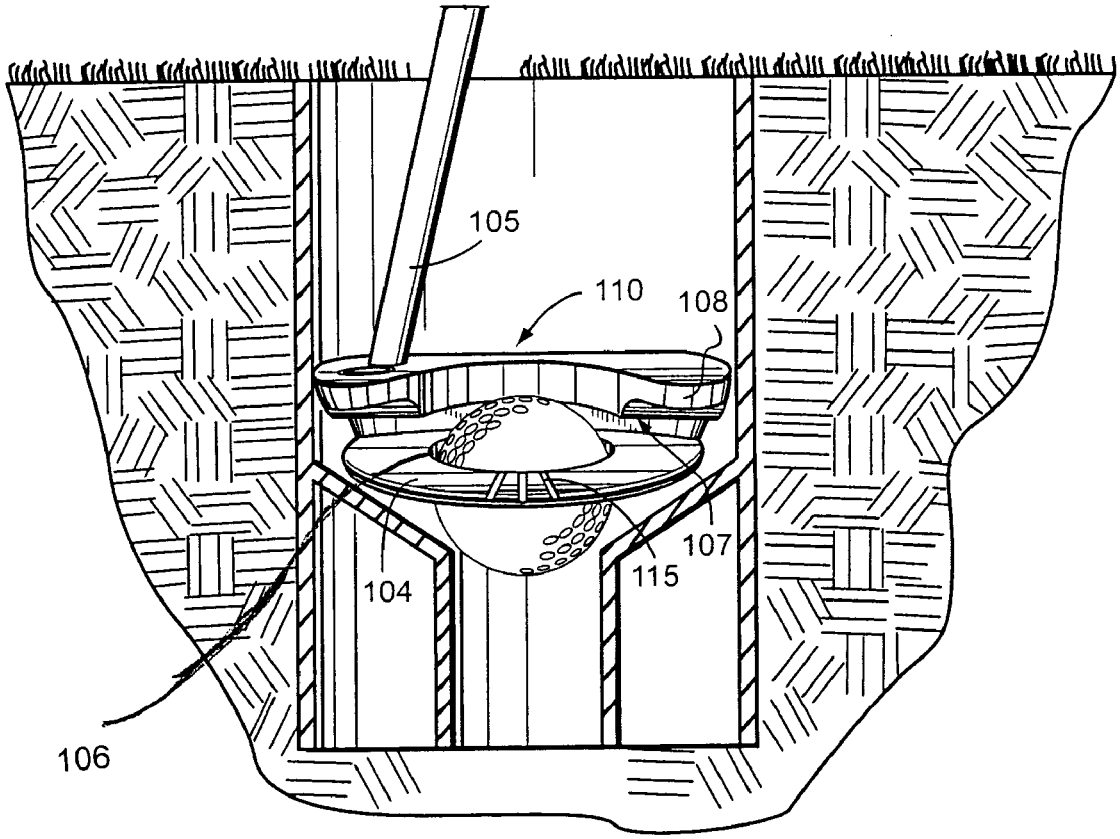
FIG. 4 shows a preferred embodiment in which putter head (102) fits within in a typical USGA conforming golf cup.

The foregoing features enable a golf ball, preferably a USGA conforming ball, to be picked-up from the ground or extracted from a golf ball cup without the need for the golfer to bend down to retrieve the golf ball. For example, in one implementation, the golfer uses the putter in a normal fashion to putt the golf ball. Once putting is completed, a golfer is able to retrieve the golf ball from the golf cup (most balls are centered in golf cups by water drainage aligners located in the cups) by centering the receiving aperture (106) over the golf ball and applying very slight pressure downward. See FIG. 4. The diameter of receiving aperture (106) provides sufficient gripping tension to grab the golf ball. Preferably, the diameter of the receiving aperture is about 0.05 to 0.10 inches (1.27–2.54 mm) less than the diameter of a typical golf ball, which by current USGA standards cannot be less then 1.680 inches in diameter. In this mode, only slight pressure is needed to retrievably engage the ball in the aperature (106) without the ball passing through the aperature (FIG. 4). If additional pressure is applied then the golf ball may be gripped between the front (128) portion of the bottom surface (107) of lip (108) and opposing section, of receiving aperture (106A). The golfer can then raise the club (100) and retrieve the golf ball from the head (102). The golf ball can then be extracted by, for example, manually pushing the ball back down through the receiving aperture (106).

Some balls are slightly smaller then the USGA standard and in such cases when the golf ball is being initially engaged, or thereafter, it is possible, to have the golf ball pass fully through receiving aperture (106) by applying additional downward pressure or weight to the club. Slight additional weight or pressure downward causes the diameter of the golf ball to pass fully through the receiving aperture (106) and into the interference fit between the bottom surface (107) of the front (128) portion of lip (108) and the back section of receiving aperture (106). The golf ball will rest in the receiving aperture (106), but the front portion (128) of the lip bottom surface (107) will prevent the golf ball from falling through receiving aperture (106) by keeping the golf ball slightly offset from the center of receiving aperture (106). At this point the golf club can be withdrawn from the cup (or the ground) by raising the head (102) out of the cup (or off the ground) and the ball can be retrieved from head (102) by hand without the need to bend down.

In addition to placing the club head over the golf ball as described above, when retrieving the golf ball from the cup and/or the ground, it is also possible to scoop a golf ball off the ground without applying any downward pressure. This may be accomplished by slightly swinging the back end (112) of the head (102) toward the golf ball with the flange directed to the bottom of the golf ball. Accordingly, when flange (104) hits/brushes against the bottom of the golf ball with slight momentum, it causes the ball to slide over the flange sections onto the receiving aperture (106) and become engaged securely between flange (104) and lip (108). In another implementation, head (102) is without a receiving aperture (106) and the golf ball may be picked-up again by swinging the back end (112) of the head (102) toward the golf ball with slight momentum. The golf ball, however, will not become engaged securely as described above with reference to FIG. 1.

As mentioned above, the diameters of various manufacturer's golf balls can vary significantly. Most golf balls are textured/dimpled and the covers are made from a variety of materials having various hardness characteristics with affect the elasticity and deformability of the cover material. Generally, the outer cover of a golf ball is soft enough and textured so that the outer layer frictionally engages the receiving aperture (106) when slight pressure is applied to the golf ball cover. Frictional engagement generally takes place slightly above the equator of the golf ball, although this will vary depending on the cover material and the deformability characteristics of the cover material. The normal dimples on a golf ball cover further increase the area of contact and deformability. Golf ball hardness is determined by the deformation (i.e., compression) of the ball under various load conditions applied across the ball's diameter (i.e., the lower the compression value, the harder the material). Thus, the receiving aperture (106) can accommodate the various outer cover materials and surface textures used by different ball manufacturers, each of which will behave slightly differently when pressure is applied.

Figure 5:
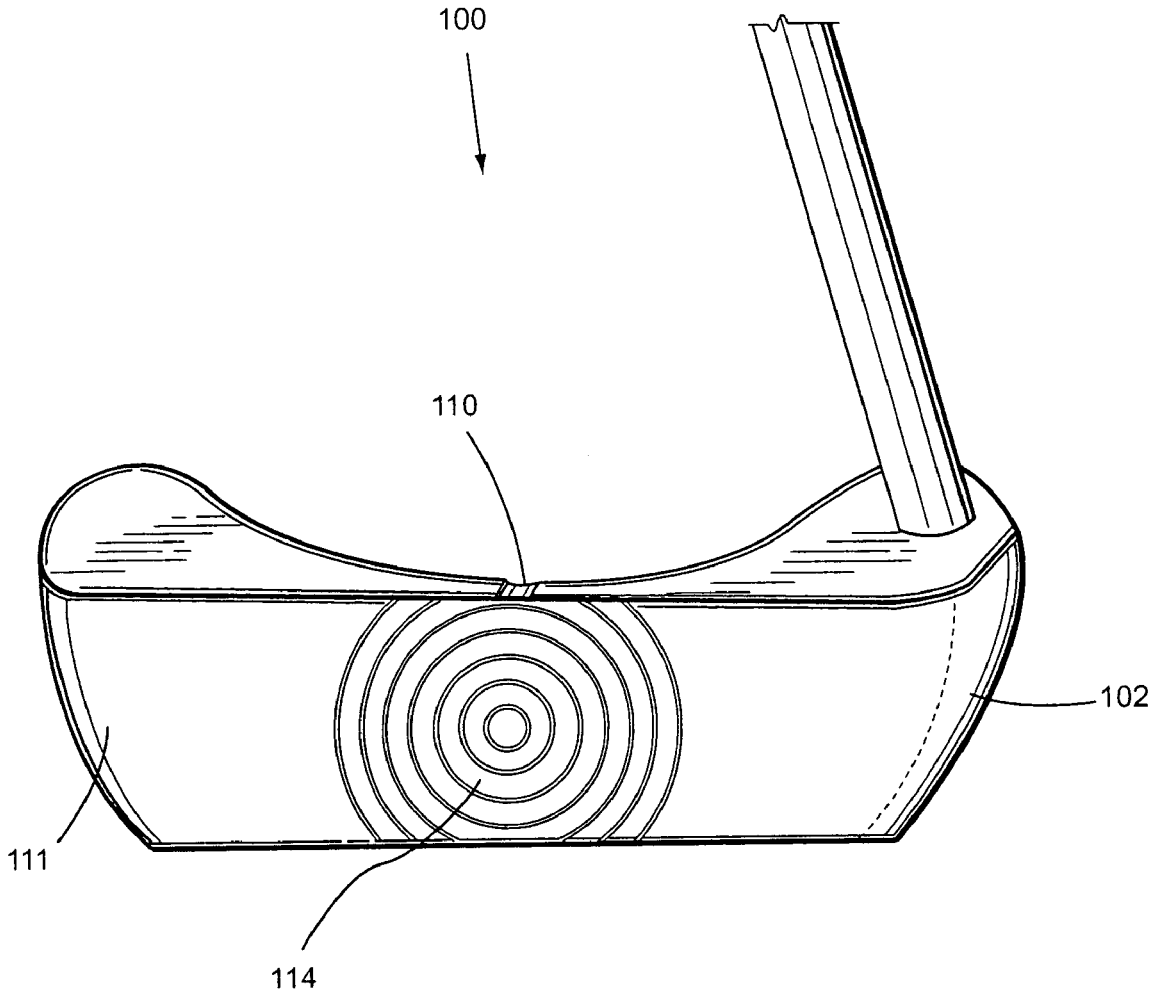
FIG. 5 shows the front surface (111) of a head (102) of golf putter (100).

FIG. 5 shows a front surface (111) of a head (102) of golf putter (100). Such front surfaces (111) are included on most heads of putters including the one shown in FIG. 1. In the exemplary illustration, front surface has a height of approximately 1 to 1.25 inches (about 25.4–31.75 mm) with a length from heel to toe of approximately 3 to 3.25 inches (about 76.2–82.55 mm). Front surface (111), has a sweet spot (110) located between the toe (103) and heel (101) of head (102). In many instances, the sweet spot (110) is approximately located at the center of the front edge (i.e., geographical center of the putter face) between the heel and toe.

Figure 6:
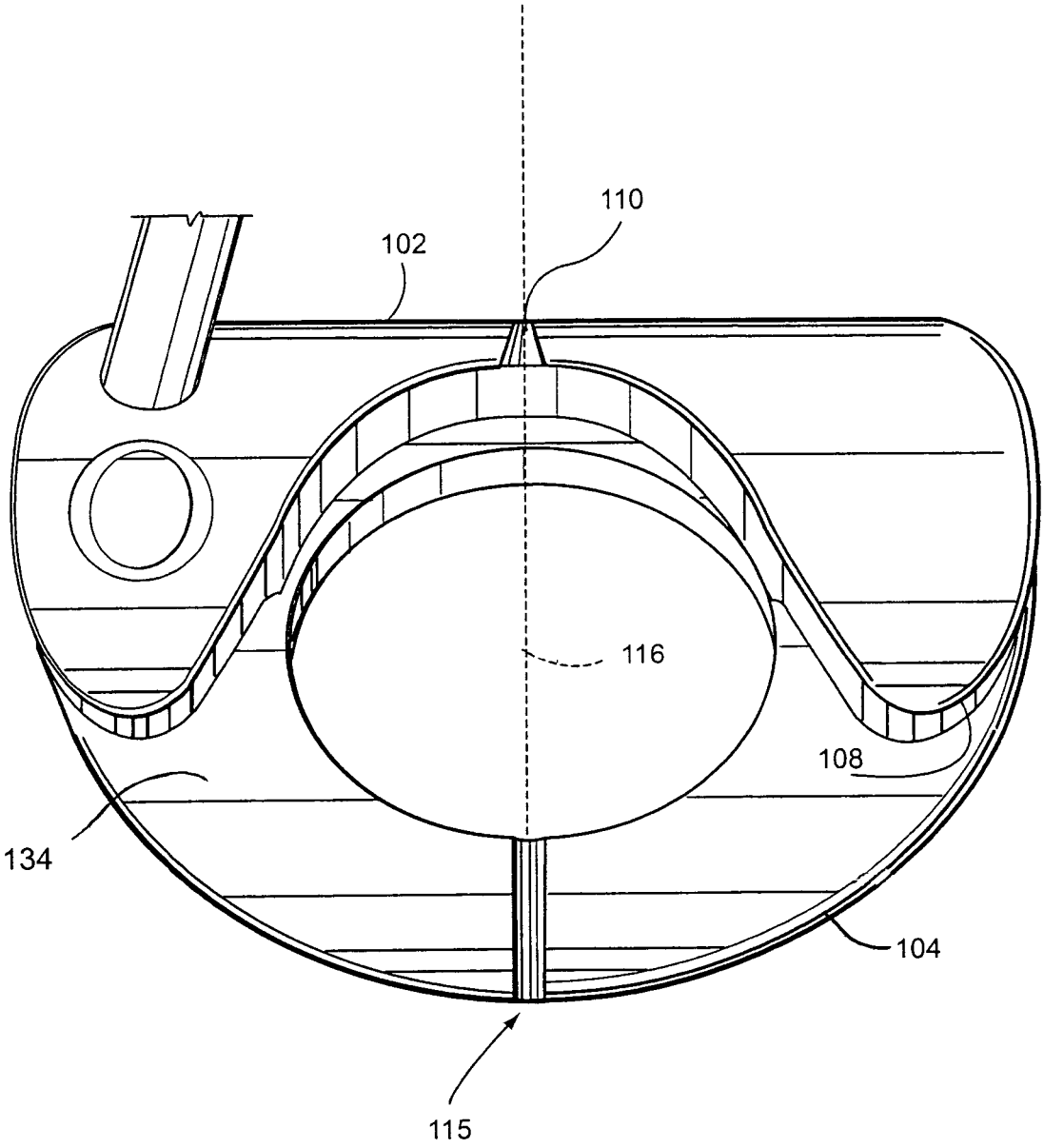
FIG. 6 is a downward rear view of the putter head (102) showing directional strip (115).

During a putting stroke, the energy imparted to the ball affecting its speed is greatest when struck with the sweet spot (110). Striking the ball on the sweet spot imparts minimal torque on the putter, thus transferring more predictable energy to the ball. Additionally, it is usually important that the face be perpendicular to the putter's motion so that the golf ball's initial direction will be in the direction of the putting stroke. Usually, one or more directional strip(s) (115) provide a visual indication to the golfer where to align the ball when striking the ball in relation to the initial direction of the putting stroke. See FIG. 6. These directional strip(s) (115) are generally located at the approximate geographical center of the head or sweet spot.

If the golfer does not exactly line up the ball with the sweet spot, there is a likelihood that the ball will not travel in the initial direction the golfer intended. Accordingly, grooves of a variety of natures can be included (e.g., embedded) on a clubface to ameliorate the effect, e.g., by helping to realign the ball towards the intended line, e.g., using horizontal grooves, vertical groves, or concentric circular grooves. FIG. 5 depicts one embodiment having grooves (114) embedded on the front surface of the head (102), which radiate outwardly from the center (120) forming an extended sweet spot. The circles are configured to realign the golf ball toward a line (116) (FIG. 6), which is perpendicular to the sweet spot (110), if the front surface (111) strikes the golf ball at a location on the head not directly aligned with the sweet spot (110). In other words, such grooves may tend to drive the golf ball with an angular force toward the line that is perpendicular to the sweet spot (110), if the ball is struck from a position off-line from the sweet spot. The grooves (114) could also be machined or molded into the front edge or secured to the front surface by other means. In one embodiment the grooves (114) are circular and each individual circular groove encircles the preceding groove. The pattern radiates outwardly from a common center point (120)(FIG. 5). This center point (120) is generally lined-up directly with the sweet spot (110). Generally there should be enough grooves embedded into the front surface to affect the ball if it is struck from an off-line position.

Figure 7:
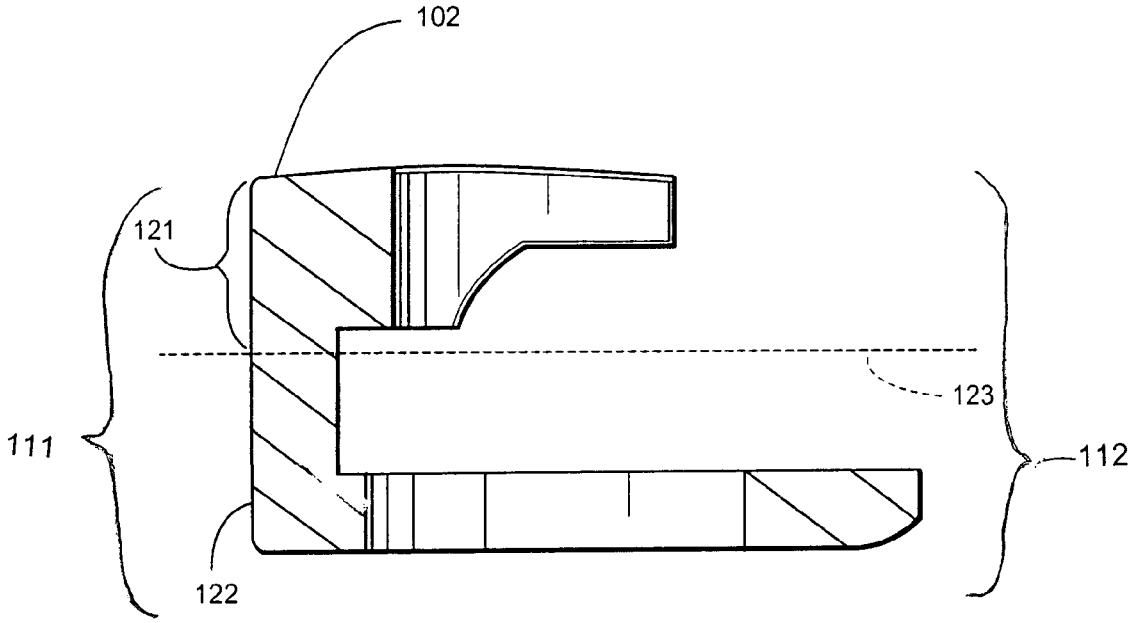
FIG. 7 shows a cross-sectional view of a putter head (102) with the majority of its mass (or weight) (121) located above a centerline (123).

FIG. 7 shows a cross-sectional view of a putter head (102) with the majority of its mass or weight (121) located above a centerline (123). In this example, the centerline (123) represents a point on the front surface, that is half way between the top and bottom of the front surface (122). For example, if the front surface has a height of 1 inch, then the majority of weight of the head would be located between the top of the front surface and, say, a half-inch above the bottom of the front surface. However, the majority of the mass (121) could be imparted at points even higher than the centerline (123). Achieving a higher mass (121) can be accomplished in a number of ways, such as by varying the configuration of the head. For example, in one implementation this is accomplished by imparting more mass (approximately 70%) in the form of club material toward the top of the head (102) than the bottom. For example, if the head weighs 350 grams, then approximately 245.0 grams of machined metal is positioned above the centerline (123).

Of course, other means could be used to achieve a higher center of mass such as attaching weights. In one implementation, the head is made of stainless steel, but other materials can be selected (e.g., titanium, wood, plastic, beryllium, copper, etc.). Locating more mass toward the top of the head tends to keep the golf ball from popping-up when struck by the front surface, by imparting more inertia at the top of the ball than below. In other words, when the golf ball is struck with the exemplary putter, at the moment of impact the ball tends to stay fixed to the green and reduces initial loft and skidding.

Figure 8:
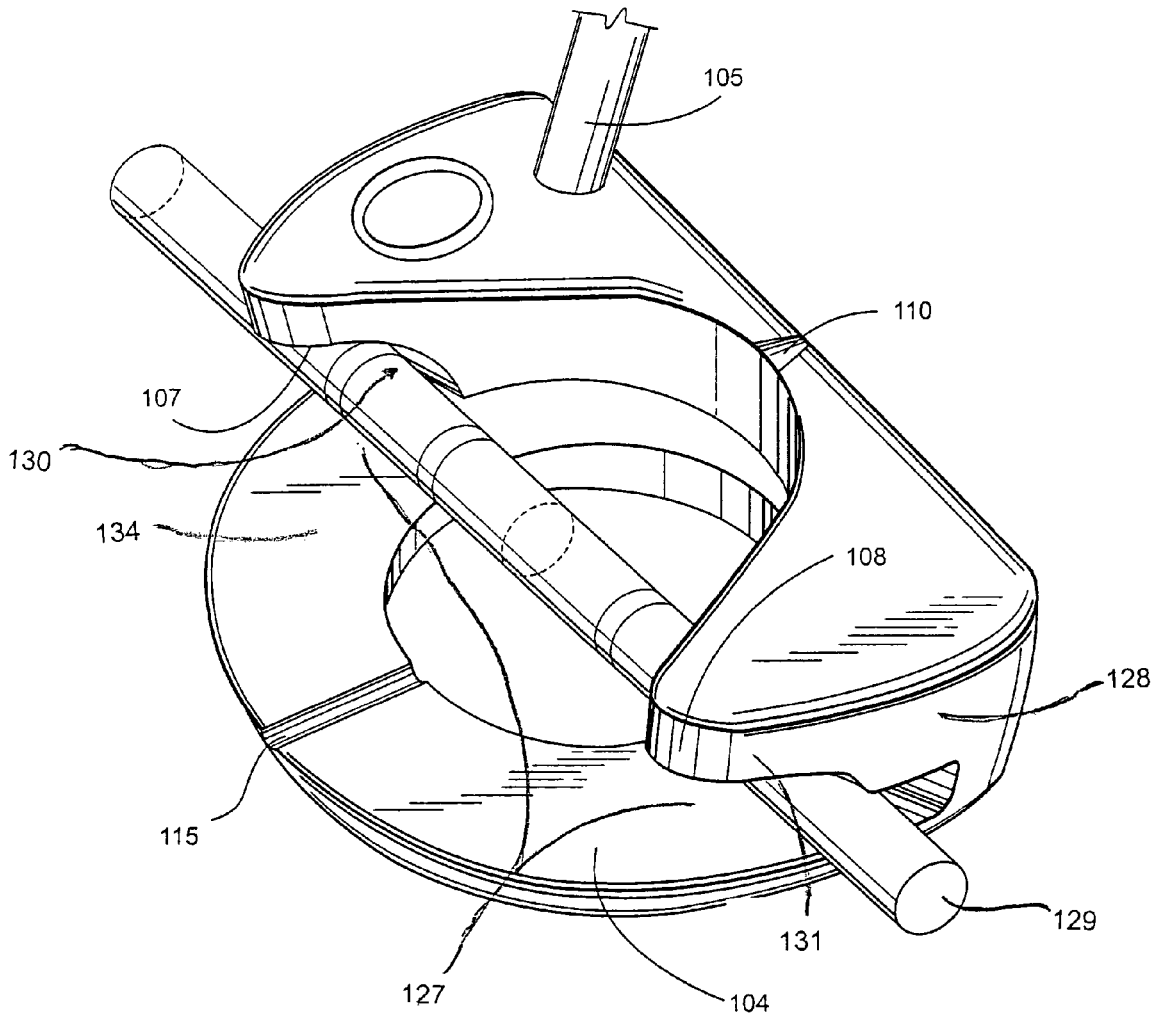
FIG. 8 depicts a flagstick engaged in the vertical space formed between the bottom flange (104) and the bottom surface (107) of the rear of the lip (108).

FIG. 8 is a view of an exemplary putter detachably coupling a pole (129) using a coupling (130) provided by a slot (127) defined by a vertical space between the top surface (134) of the bottom flange (104) and the rear portion (131) of the bottom surface (107) of the lip (108). The top surface (134) and bottom surfaces (107) frictionally engage the pole with slot (127) so that the pole is readily gripped and released. While a pole is depicted, it is contemplated that other objects can be engaged in the slot/vertical space (127) between the bottom flange and the lip (e.g. a club shaft, etc.).

It should be noted that a club head may be implemented with one or more of the aforementioned features. Although some implementations of the various methods and arrangements of the present invention have been illustrated in the accompanying drawings and described in the foregoing, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The invention claimed is:

1. A putter head useful for retrieving a golf ball comprising:

a front putter face having a top and bottom, a bottom flange extending rearward from said putter face, said flange having a top and bottom surfaces and a ball receiving aperture that has a diameter sufficient that the edges of the receiving aperture grip said ball when the receiving aperture is pressed against said ball, said flange being sufficiently thin at the point of contact with said gripped ball to permit passage of said gripped ball through said receiving aperture upon application of additional downward force, and a surface extending rearward from the top of the front face of the putter forming a lip with top and bottom surfaces, which lip extends over said receiving aperture such that, when said ball passes upwardly through said receiving aperture, it is situated at rest off-center with respect to said receiving aperture preventing the ball from passing downwardly through said receiving aperture by the force of gravity, wherein the bottom surface of said lip and the top surface of said bottom flange have a vertical spacing of about 0.2 to about 0.75 inch, and wherein said lip thins towards the rear so that it is sufficiently spaced from said bottom flange to form a slot that can accommodate a flagstick or golf club shaft.

2. A putter head of claim 1, wherein said edges of said receiving aperture are from about one eighth to about three sixteenths inch thick.

3. A putter head of claim 1, wherein said receiving aperture diameter is less than 1.684 inches but greater than 1.584 inches.

4. A putter head of claim 3, wherein said receiving aperture diameter is less than 1.684 inches but greater than 1.674 inches.

5. A putter head of claim 4, wherein said receiving aperture diameter is 1.676 to 1.680 inches.

6. A putter head of claim 1, wherein said rearward extending top surface forms a lip which does not extend more than 0.1 inch over the outer diameter of said ball receiving aperture of said bottom flange.

7. A putter head of claim 1, which has more weight in its upper half than in its bottom half.

8. A putter head of claim 1, wherein said rearward extending top surface forms a lip which does not extend rearward more than halfway over said bottom flange.

9. A putter head of claim 1, wherein said bottom surface of said lip and the top surface of said bottom flange are generally parallel to each other and have a vertical spacing of about 0.2 to about 0.5 inch.

10. A putter head of claim 1, wherein said rearward extending top surface forms a lip which is thicker towards the face of the head.

11. The putter head of claim 1, further comprising a golf putter shaft and handle/grip.

12. A putter head of claim 1, whose largest dimension is less than 4 inches in diameter.

* * * * *